United States Patent [19]

Wyss

[11] 4,146,576

[45] Mar. 27, 1979

[54] MANUFACTURE OF CARBON FIBRES

[75] Inventor: Walter F. Wyss, Great Bookham, England

[73] Assignee: Coal Industry (Patents) Limited, London, England

[21] Appl. No.: 174,553

[22] Filed: Aug. 24, 1976

[30] Foreign Application Priority Data

Sep. 8, 1970 [GB] United Kingdom ..... 42995/70

[51] Int. Cl.[2] ..... D01F 9/14; C01B 31/02

[52] U.S. Cl. ..... 423/447.4; 264/29.2; 423/447.6; 423/449

[58] Field of Search ..... 23/209.1 F; 423/447; 264/176 F, 29

[56] References Cited

U.S. PATENT DOCUMENTS

| | | | |
|---|---|---|---|
| 1,925,005 | 8/1933 | Rose et al. | 44/1 |
| 3,595,946 | 7/1971 | Joo et al. | 264/29 |
| 3,639,953 | 2/1972 | Kimura et al. | 264/29 |

OTHER PUBLICATIONS

Otani, Carbon 1965, vol. 3, pp. 31–38.

*Primary Examiner*—Edward J. Meros

*Attorney, Agent, or Firm*—Stevens, Davis, Miller & Mosher

[57] ABSTRACT

The invention relates to an improvement in a process for the production of carbon fibres (also filaments and films) from organic material consisting mainly of hydrocarbons (e.g., pitch, tars, solutions or extracts of coal). The organic material is spun or extruded to form a fibre, oxidized to stabilize it to heat treatment and subsequently carbonized. The invention comprises employing in place of, or as, the organic material consisting mainly of hydrocarbons a modified organic material formed by reacting an aromatic hydrocarbon material having at least two fused rings (which may be such an organic material consisting mainly of hydrocarbons) with a cross-linking agent, the cross-linking agent having at least two groups selected from groups that react with and substitute onto aromatic hydrocarbon rings. Suitable groups include acyl chloride, alkyl chloride, carboxylic acid anhydride, olefin, and alcoholic hydroxyl groups.

1 Claim, No Drawings

MANUFACTURE OF CARBON FIBRES

This invention relates to improvements in or relating to the manufacture of fibres, filaments and films consisting essentially of carbon.

It has been proposed to produce fibres, filaments and films consisting essentially of carbon by extruding or spinning certain organic materials consisting mainly of hydrocarbons to form a fibre, filament or film, oxidizing the fibre, filament or film whereby the fibre, filament or film is stabilized to heat treatment, and carbonising the stabilized fibre, filament or film, whereby a fibre, filament or film consisting essentially of carbon is formed.

British patent specification No. 1,071,400 describes such a process wherein the organic material consisting mainly of hydrocarbons comprises a substance exhibiting a molten state resulting from baking in an oxygen-free atmosphere at a temperature of from 300° to 500° C. an organic substance selected from the group consisting of natural or synthetic organic substances which will produce said molten substance as a result of said baking. Examples of the natural or synthetic organic substances alleged to be suitable for use in the process of British patent specification No. 1,071,400 include synthetic high polymeric substances such as polyvinyl chloride and polyacrylonitrile, natural organic substances such as petroleum pitch, coal and coal pitch, and pitches and tars formed by distillation or pyrolysis in the manufacture of certain organic compounds.

British patent specification No. 1,091,890 describes a similar process to that of British patent specification No. 1,071,400 wherein the organic material consisting mainly of hydrocarbons comprises a pitch or pitch-like substance having a C/H atomic ratio between 0.85 and 1.60 and a mean molecular weight or not less than 400. Such pitches or pitch-like substances may include petroleum pitches, coal-tar pitches and pitches produced as by-products in various industrial processes. Pitches having the requisite properties may be formed by transformation of other pitches for example by heating, optionally in the presence of additives such as inorganic halides e.g., aluminum trichloride or organic peroxides, e.g., dicumyl peroxide.

Copending application for United Kingdom Pat. No. 42675 dated Aug. 27, 1969 corresponding to U.S. patent application No. 67,000 filed Aug. 27, 1970, now abandoned describes and claims a process for producing fibres, filament or films consisting essentially of carbon which comprises spinning or extruding a solution or extract of coal to form a fibre, filament or film, oxidizing the spun or extruded fibre, filament or film to form a fibre, filament or film stabilized to heat treatment and carbonizing the stabilized fibre, filament or film.

By "solution or extract of coal" it is meant to include those products formed by the treatment of coals with high boiling aromatic solvents, but other solvents, for example chloroform and pyridine, may also be employed. By "high boiling aromatic solvents" it is meant to include those solvents boiling above about 200° C. and which contain at least one aromatic ring. Such solvents are known, in general, to dissolve or extract at least a portion of the aromatic matter from coal. The dissolution or extraction may include degradation of the coal molecules, whether solvolytically or otherwise, and it is not intended to imply that no chemical reactions take place. Suitable solvents include polynuclear aromatic hydrocarbons, for example phenanthrene, although it will not be normal to employ pure compounds as solvents for economic reasons. Mixtures of high boiling hydrocarbons formed from coal are particularly suitable solvents, for example anthracene oils. Hydrogenated polycyclic hydrocarbons may be used but these normally react with the coal in a well-known manner and hydrogenate the coal, forming aromatic hydrocarbons, and can therefore not be recovered; for example, tetralin is dehydrogenated to naphthalene. It may sometimes be convenient to form the solution or extract of coal by so treating the coal in the presence of hydrogen gas which reacts with the coal. In the case where a low boiling point solvent has been employed to produce a solution or extract of coal, it is preferred to employ substantially solvent-free extract of coal produced from such a solution or extract. The term "solution or extract of coal" is not intended to be limited to products formed by the liquid phase dissolution or extraction of coal but to include those products formed by treating coal, or a solution or extract thereof, with a solvent in the gaseous phase, at either above or below the critical pressure and temperature of the gaseous solvent, and condensing the portion of the coal dissolved or entrained in the gaseous solvent. Such solvents are not limited to those that are liquid at ambient conditions but may include, for example, ethylene and other gases. Any coal may, in principle, be employed to form the solution or extract. The term "coal" is intended to include materials that are of a coal-like nature and which contain dissolvable material, for example lignite.

The solution or extract of coal is then spun or extruded at a temperature generally just above the melting or softening point of the solution or extract. The fibre, filament or film so spun or extruded may be drawn or stretched during or immediately after spinning or extrusion in order to form the fibre, filament or film to be heat treated. The spun or extruded fibre, filament or film is then oxidized, preferably under a small tension, to stabilize the fibre, filament or film to heat treatment, rendering it infusible. The oxidation may be carried out in an oxidizing atmosphere, for example air, oxygen or ozone, at an elevated temperature, for example 250° C. The stabilized fibre, filament or film is then heated, preferably under a small tension, to a temperature within the range of 600° C. to 3000° C. in an inert atmosphere to carbonize it.

The present invention provides an improvement in a process for the production of fibres, filament and films consisting of carbon by spinning or extruding organic material consisting mainly or hydrocarbons to form a fibre, filament or film consisting of the organic material, oxidizing the fibre, filament or film whereby the spun or extruded fibre, filament or film is stabilized to heat treatment and carbonising the stabilized fibre, filament or film whereby a fibre, filament or film consisting essentially of carbon is formed, wherein, in place of, or as, the organic material consisting essentially of hydrocarbons, there is employed a modified organic material formed by reacting an aromatic hydrocarbon material having at least two fused rings with a cross-linking agent, the cross-linking agent having at least two groups selected from groups that react with and substitute onto aromatic hydrocarbon rings.

Any suitable compound may be employed as a cross-linking agent in the present invention. The cross-linking agent preferably has all the groups that react with the aromatic hydrocarbon material of one kind to minimize the undesirable effects of having different rates of reaction of different groups with the aromatic hydrocarbon material. It is preferred that the cross-linking agent should have two only of such groups so that a substantially linear chain may be formed.

Suitable groups that react with and substitute aromatic hydrocarbon rings include acyl chloride groups, alkyl chloride groups, carboxylic acid anhydride groups, although it is to be understood that anhydrides may be considered, for the purposes only of considering the number of reactive groups, as being the acid from which they are derived, alkenically unsaturated groups, particularly those unconjugated with aromatic rings, and alcoholic hydroxy groups, particularly methylol groups directly attached to aromatic rings. Certain of the aforementioned groups react with and substitute aromatic hydrocarbon rings only in the presence of a catalyst, particularly a Friedel-Crafts catalyst, and requisite catalysts must be present. Acid chlorides that may be employed include polychlorides of aliphatic or aromatic polycarboxylic acids, and of aromatic polysulphonic acids, for example the dichloride derived from adipic acid, the dichloride derived from terephthlalic acid, benzenedisulphonyl chlorides toluenedisulphonyl chlorides and naphthalenedisulphonyl chlorides. Suitable types of alkyl chlorides that may be employed include chlorinated alkanes, such as those that are commercially available formed by chlorinating n-alkane cuts of about $C_{14}$ to $C_{18}$ and having an average chlorine content of up to about 5 chlorine atoms per molecule. More preferred alkyl chlorides are $\alpha,\omega$-dichloro derivatives of alkanes, particularly n-alkanes, having desirably 4 to 8 carbon atoms in the chain. Examples include 1,4-dichlorobutane, 1,8-dichlorooctane, 1,3-dichloro-2,2-dimethylpropane, 2,5-dichloro-2,5-dimethylhexane and 1,12-dichlorododecane. Alkyl halides having aromatic substituents may be employed, for example di(-chloromethyl)benzene. Acid anhydrides that may be employed include those derived from aliphatic or aromatic polycarboxylic acids, for example adipic anhydride, phthalic anhydride, and pyromellitic anhydride. Carboxylic anhydrides derived from dicarboxylic acids may react initially to form a mono-carboxylic acid which reacts with and substitutes aromatic rings only slowly; such anhydrides are therefore not preferred, but those derived from tetracarboxylic acids may be employed. Unsaturated compounds that may be employed as cross-linking agents may be conjugated or unconjugated and include monomers and polymers. Typical types of monomer that may be employed include those known generally as drying and semi-drying oils, for example linseed oil, as well as simple dienes, including dialkenes, for example butadiene, isoprene and 1,5-hexadiene, and diallylesters of dicarboxylic acids, for example diallyl phthalate. Unsaturated rubbers may be employed as cross-linking agents if desired, for example butadiene-styrene copolymers or butadiene acrylonitrile copolymers or other copolymers of butadiene or copolymers of isoprene or derivatives thereof. The use of rubbers is not always desirable since they may have other, possibly undesirable, effects on the properties of the product and may also be difficult to control in their reaction with the aromatic hydrocarbon material. Rubbers may break down, diminishing the softening point of the aromatic hydrocarbon material. However, the breakdown products may themselves comprise the cross-linking agent, reacting with the aromatic hydrocarbon material. Many compounds having alcoholic hydroxyl groups may dehydrate before reacting with the aromatic hydrocarbon material so that it is the olefin derived from such compounds that reacts. Particularly suitable cross-linking agents having alcoholic hydroxyl groups are $\alpha,\omega$-diols derived from alkanes having at least 4 carbon atoms in the chain for example butan-1,4-diol, and dodecan-1,12-diol. Preferred cross-linking agents having two or more alcoholic hydroxyl groups are those compounds formed by the reaction of formaldehyde with phenols, for example with phenol. This is the same reaction employed in the manufacture of phenolformaldehyde resins in the resol form. Examples of the most suitable types of compounds are di(methylol)-phenol and di(hydroxy-methylolphenyl)-methane.

The aromatic hydrocarbon material having at least two fused rings may be an organic material consisting mainly of hydrocarbons as described in British patent specification Nos. 1,071,400 or 1,091,890 hereinbefore referred to. Alternatively, it may be the extract or solution of coal as described and claimed in the copending application for United Kingdom Pat. No. 42675 dated Aug. 27, 1969. It may also be an aromatic fraction formed in coal tar or petroleum refining but which is by itself unsuitable for use in the processes for the manufacture of fibres, filaments or films consisting of carbon hereinbefore mentioned. Such fractions may include, for example, naphthalene, methylnaphthalenes, acenaphthalene, fluorene, phenanthrene, anthracene and carbazole, as well as derivatives thereof. It will be understood that such solutions or extracts of coal, as well as pitches and pitch-like and other material, including coal tar, derived from coal, and such other organic material as can be employed in the processes referred to, will contain compounds other than hydrocarbons, particularly heterocyclic aromatic ompounds for example pyridines, pyrroles and fused-ring derivatives thereof and phenols, generally in amounts which are under 15% of the total weight of the organic material. For the avoidance of doubt, it is to be understood that material of such kind containing quantities of non-hydrocarbon matter as is found in material of such types as are hereinbefore described is to be considered as an aromatic hydrocarbon material for the purposes of the present invention.

The whole of the organic material need not be so modified but a portion only thereof may be modified. Advantageously, the portion so modified is mixed with the remainder of the organic material consisting essentially of hydrocarbons which may, if desired, be from a different source from the aromatic hydrocarbon material.

The modified organic material generally has a higher melting point than unmodified organic material. It has, however, certain advantages in that it is often easier to spin or extrude. The spun or extruded fibre, filament or film is often stronger than that derived from unmodified organic material. The modified organic materials have different viscosity/temperature relationships to that of unmodified organic materials, and suitable admixtures can be made having the particular properties desired. Fibres, filaments and films spun or extruded from the modified organic materials or mixtures including the modified organic materials may often be oxidized more rapidly to form the fibre, filament or film stabilized to heat treatment than the unmodified organic materials or mixtures not including the modified organic materials.

The modified organic material of the present invention may be used in conjunction with any modification of the processes using the unmodified organic material hereinbefore referred to. For example, it may be employed in conjunction with additives or other or further treatments, including chemical treatment, of the organic material or in the spinning or extrusion or of the spun or extruded fibre, filament or film. Examples of these are given in applications for United Kingdom Pat. Nos. 42991 and 42992 both dated Sept. 8, 1970, corresponding respectively to U.S. patent applications Nos. 174,554, now abandoned by Powell, Winte and Fuller and 174,552 by Powell, Winter and Pirtchard, both filed Aug. 24, 1971 now Pat. No. 3,852,428.

The following non-limitative example illustrates the invention.

EXAMPLE

A solution or extract of coal was prepared by treating a bright coal of 84% carbon content, calculated on a dry, mineral-matter free basis, with three times its weight of anthracene oil at 400° C. under pressure in an inert atmosphere. The coal extract was filtered and excess anthracene oil was distilled off at about 300° C. and 10 torr to leave a solution or extract of coal containing about equal quantities of material derived from the coal and anthracene oil.

The solution or extract was mixed with 1% by weight of a mixed benzene-disulphonylchloride, by grinding. The mixture was heated to 300° C. under nitrogen for four hours in order to complete the reaction. The product was cooled, broken up and ground.

The product was extruded through a 380 μm die at a temperature of 250° C. and drawn at a draw rate of 1.7 m/s to produce a continuous extruded fibre. A two of about 500 fibres so extruded, about 100 to 200 mm long, was suspended in an oven and kept straight under a tension of about 1 mg/fibre during subsequent processing. The two of fibres was heated in oxygen to 270° C. at a rate of 10° C./min and then in nitrogen at a rate of 850° C./h to 1000° C. at which temperature the tow was treated for one hour.

The fibres had diameters of about 10.8 μm., tensile strengths of about 0.86 $GN/m^2$, and Young's moduli of about 48 $GN/m^2$ (mean values in each case).

For comparison, a portion of the solution or extract of coal was not reacted with the benzenedisulphonylchloride. A fibre was spun in an analogous manner to the foregoing, but the spun fibre could not be oxidized at a heating rate of above 2.6° C./min. After oxidation and carbonization these fibres had diameters of about 11 μm, tensile strengths of about 0.99 $GN/m^2$ and Young's moduli of about 45 $GN/m^2$.

I claim:

1. A process for the production of fibres, filaments and films consisting essentially of carbon comprising mixing a solution or extract of coal with 1% by weight of benzenedisulphonylchloride, heating said mixture to 300° C. in an oxygen-free atmosphere for a period of four hours, cooling said mixture, extruding said mixture at a temperature of 250° C., heating said extruded product in oxygen to 270° C. at a rate of 10° C./minute and heating the resultant product in nitrogen at a rate of 850° C./hr to 1000° C.

* * * * *